US012295445B2

(12) United States Patent
Howe

(10) Patent No.: US 12,295,445 B2
(45) Date of Patent: May 13, 2025

(54) HELMET, SYSTEM, AND METHOD FOR PROVIDING PROTECTIVE HEADGEAR TO WEARER'S WITH A COCHLEAR IMPLANT

(71) Applicant: Josephine Consulting L.L.C., Indianapolis, IN (US)

(72) Inventor: Ellie Josephine Howe, Plymouth, MN (US)

(73) Assignee: JOSEPHINE CONSULTING L.L.C., Indianapolis, IN (US)

( * ) Notice: Subject to any disclaimer, the term of this patent is extended or adjusted under 35 U.S.C. 154(b) by 0 days.

(21) Appl. No.: 18/364,599

(22) Filed: Aug. 3, 2023

(65) Prior Publication Data

US 2024/0065363 A1 Feb. 29, 2024

Related U.S. Application Data

(60) Provisional application No. 63/374,109, filed on Aug. 31, 2022.

(51) Int. Cl.
*A42B 3/16* (2006.01)
*A42B 3/12* (2006.01)

(52) U.S. Cl.
CPC . *A42B 3/16* (2013.01); *A42B 3/12* (2013.01)

(58) Field of Classification Search
None
See application file for complete search history.

(56) References Cited

U.S. PATENT DOCUMENTS

| | | | | |
|---|---|---|---|---|
| 2,619,639 | A * | 12/1952 | Hendler | A42B 3/12 2/181.2 |
| 2,871,481 | A * | 2/1959 | Gerstin | A42B 3/16 2/6.6 |
| 9,247,780 | B2 * | 2/2016 | Iuliano | A42B 3/046 |
| 11,026,466 | B2 * | 6/2021 | Vanhoutin | A42B 3/128 |
| 11,812,808 | B2 * | 11/2023 | Morgan | A61B 5/11 |

FOREIGN PATENT DOCUMENTS

| | | | | |
|---|---|---|---|---|
| CN | 215025268 U | * | 12/2021 | A61N 1/36 |

* cited by examiner

*Primary Examiner* — Katherine M Moran
(74) *Attorney, Agent, or Firm* — Shumaker, Loop & Kendrick, LLP; James D. Miller

(57) ABSTRACT

A helmet, system, and method are described for providing a helmet for wearers with a cochlear implant or similar device. To accomplish this feat, the helmet will have at least one insert on the inner surface that accommodates and protects the cochlear implant device on the wearer's head. The described helmet, system, and method may be used for various activities including, but not limited to, biking, football, and skiing.

3 Claims, 7 Drawing Sheets

HELMET, SYSTEM, AND METHOD FOR PROVIDING PROTECTIVE HEADGEAR TO WEARER'S WITH A COCHLEAR IMPLANT

CROSS-REFERENCE TO RELATED APPLICATIONS

This application claims priority from U.S. Provisional Patent Application No. 63/374,109, filed on Aug. 31, 2022, in the United States Patent and Trademark Office. The disclosure of which is incorporated herein by reference in its entirety.

FIELD

The present invention relates generally to protective headgear, and more particularly to protective helmets compatible with hearing devices, such as a cochlear implant.

BACKGROUND OF THE INVENTION

Cochlear implants were approved in the United States in the 1980's. Since then, in the United States, roughly 118,100 devices have been implanted in adults and 65,000 in children. The implant is composed of both an internal and external portion: the external portion contains a microphone with a receiver/processor that converts sounds from the environment to electrical impulses, while the internal portion contains an electrode array that propagates the impulses to the auditory nerve. After receiving a cochlear implant each patient must learn or relearn hearing with this new device. Additionally, patients must get familiar with having the external portion of the device on their head. This may mean changing their daily habits to adjust to the implant.

Helmets are worn during activities with potential head impacts. Anything from horseback riding to skateboarding to baseball requires a helmet for optimal safety. While helmets come in many shapes and sizes depending on the activity, the overall physical structure and function remains the same: A helmet has a hard, plastic shell on the outside and foam on the inside. If you hit your head, the materials in a helmet function to dissipate the force and energy of the impact, which reduces the force applied to the skull. The foam cushions the blow to the head, while the smooth, plastic outer shell allows your head to safely skid across the surface of impact without jerking your neck.

This same foam that cushions the skull from the brunt of the impact presents a big problem for users with cochlear implants. It uncomfortably and unsafely pushes on the external portion of a cochlear implant. Helmets are designed to press tightly against the skull; loosening a helmet to fit a cochlear implant will have a significantly lesser effect in dissipating the force during an impact to the head.

BRIEF SUMMARY

Therefore, there is a need for a helmet configured for use by a wearer with a cochlear implant to maximize the intended use of a snug fitting helmet and minimize discomfort for cochlear implant users. The present invention solves this problem by providing a helmet, a system for customizing a helmet, and a method of customizing a helmet for use by a wearer with a cochlear implant.

In one aspect, disclosed herein is a helmet is disclosed comprising an outer surface, an inner surface, and one or more inserts positioned on the inner surface, forming a void configured to encompass and support an external portion of a cochlear implant.

In certain aspects, the helmet further comprises one or more cushioning pads positioned adjacent the inner surface, wherein the one or more cushioning pads forms an aperture configured to receive the one or more inserts. In certain aspects, the aperture is an oval. In certain aspects, the aperture is a rectangle. In certain aspects, the aperture is irregularly shaped.

In certain aspects, the one or more inserts are comprised of polystyrene. In certain aspects, the one or more inserts are comprised of polylactic acid. In certain aspects, the one or more inserts are comprised of polyurethane. In certain aspects, the one or more inserts are comprised of silicone. In certain aspects, the one or more inserts are comprised of expanded polystyrene. In certain aspects, the one or more inserts are comprised of neoprene.

In certain aspects, the one or more inserts is one insert comprising a slot configured to receive a cord of the cochlear implant. In certain aspects, the one or more inserts is two inserts. In certain aspects the two inserts are mirror images.

In certain aspects, the one or more inserts are attached to the inner surface of the helmet by hook-and-loop connectors or an adhesive.

In certain aspects, the helmet further comprises an accessory selected from the group consisting of a face guard, a visor, a chin-strap, or a combination thereof.

In another aspect, disclosed herein is a system for customizing a helmet for a wearer with a cochlear implant. The system comprises one or more inserts forming a void configured to encompass and protect a cochlear implant.

In certain aspects, the one or more inserts is one insert, and wherein the one insert comprises a slot configured to receive a cord of the cochlear implant.

In certain aspects, the one or more inserts is two inserts. In certain aspects, each of the two inserts are mirror images of each other.

In certain aspects, the one or more inserts are comprised of polystyrene, polylactic acid, polyurethane, silicone, expanded polystyrene, neoprene, and some combination thereof.

In another aspect, disclosed herein is a method comprising: (a) providing a piece of molding to a wearer, wherein the molding is configured to conform to the wearers head to obtain an impression conveying a cochlear implant, a measurement of the cochlear implant, and a location of the cochlear implant on the wearers head; (b) selecting one or more inserts to fit around the cochlear implant, based on the impression; and (c) assembling the one or more inserts on and/or within the inner surface of a helmet.

In certain aspects, the one or more inserts is one insert, and wherein the one insert comprises a slot configured to receive a cord of the cochlear implant.

In certain aspects, the one or more inserts is two inserts. In certain aspects, each of the two inserts are mirror images of each other.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

The drawings described herein are for illustrative purposes for selected embodiments and not all possible implementations, and are not intended to limit the scope of the present disclosure.

DETAILED DESCRIPTION OF EMBODIMENTS OF THE INVENTION

Figure 1:
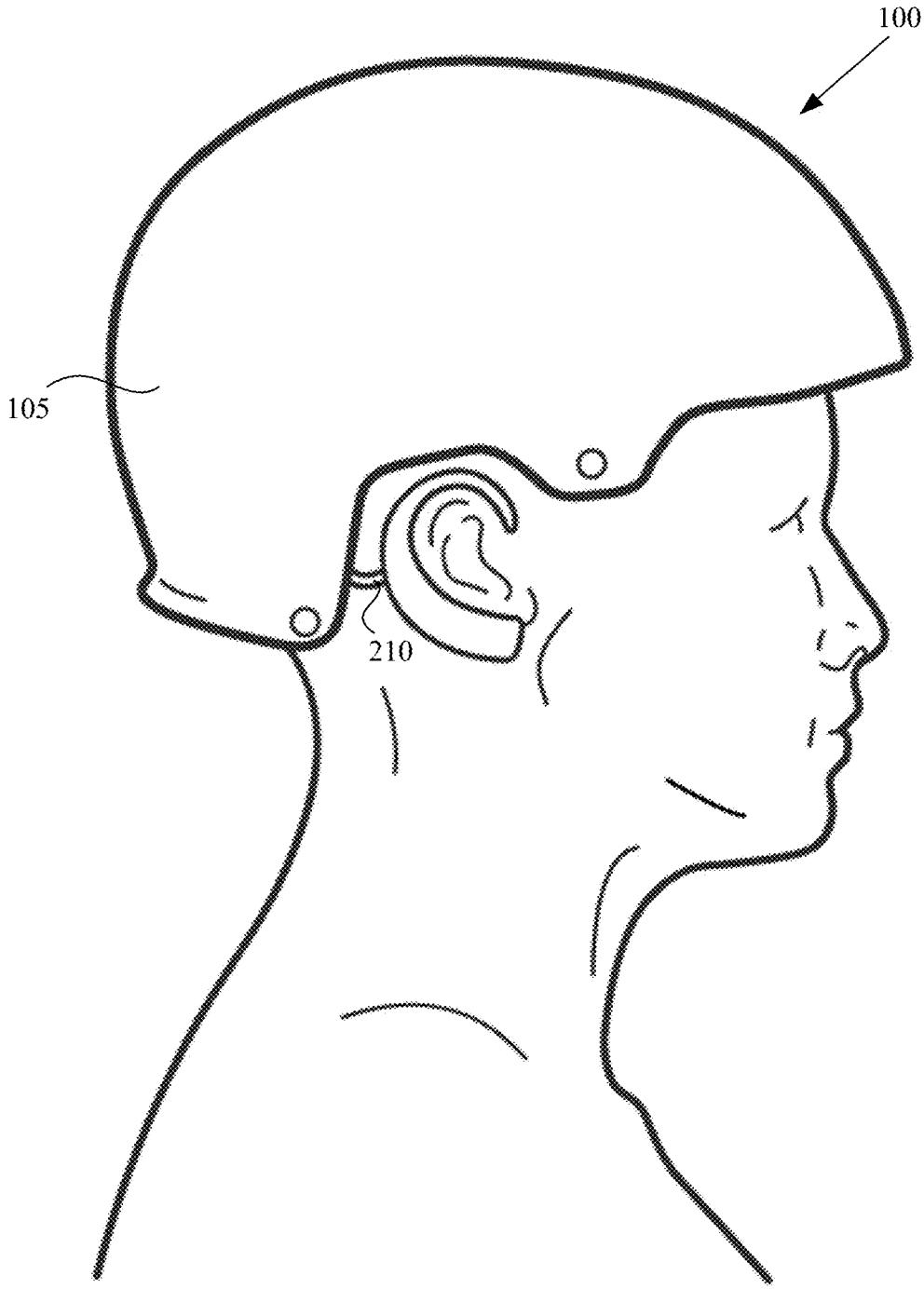
FIG. 1 is a side view of a helmet and helmet system worn by a user, in accordance with at least one embodiment.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

It must be noted that, as used in the specification and the appended claims, the singular forms "a," "an" and "the" include plural referents unless the context clearly dictates otherwise.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Measurements, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within the ranges as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. as well as 1, 2, 3, 4, and 5, individually. The same principle applies to ranges reciting only one numerical value as a minimum or a maximum. Furthermore, such an interpretation should apply regardless of the breadth of the range or the characteristics being described.

As stated above, there is currently no helmet available for people with cochlear implants. One difficulty in manufacturing a helmet for this population is the variation amongst implant manufacturers as well as the variability in implant location from patient to patient. To remedy this deficit, a helmet, a system, and a method are presented herein for customizing a helmet for wearer's with a cochlear implant. The system for customizing a helmet for a wearer with a cochlear implant includes insert(s) forming a void configured to encompass and protect the external portion of the cochlear implant. The insert(s) may have a slot to receive the cord of the cochlear implant.

Figure 2:
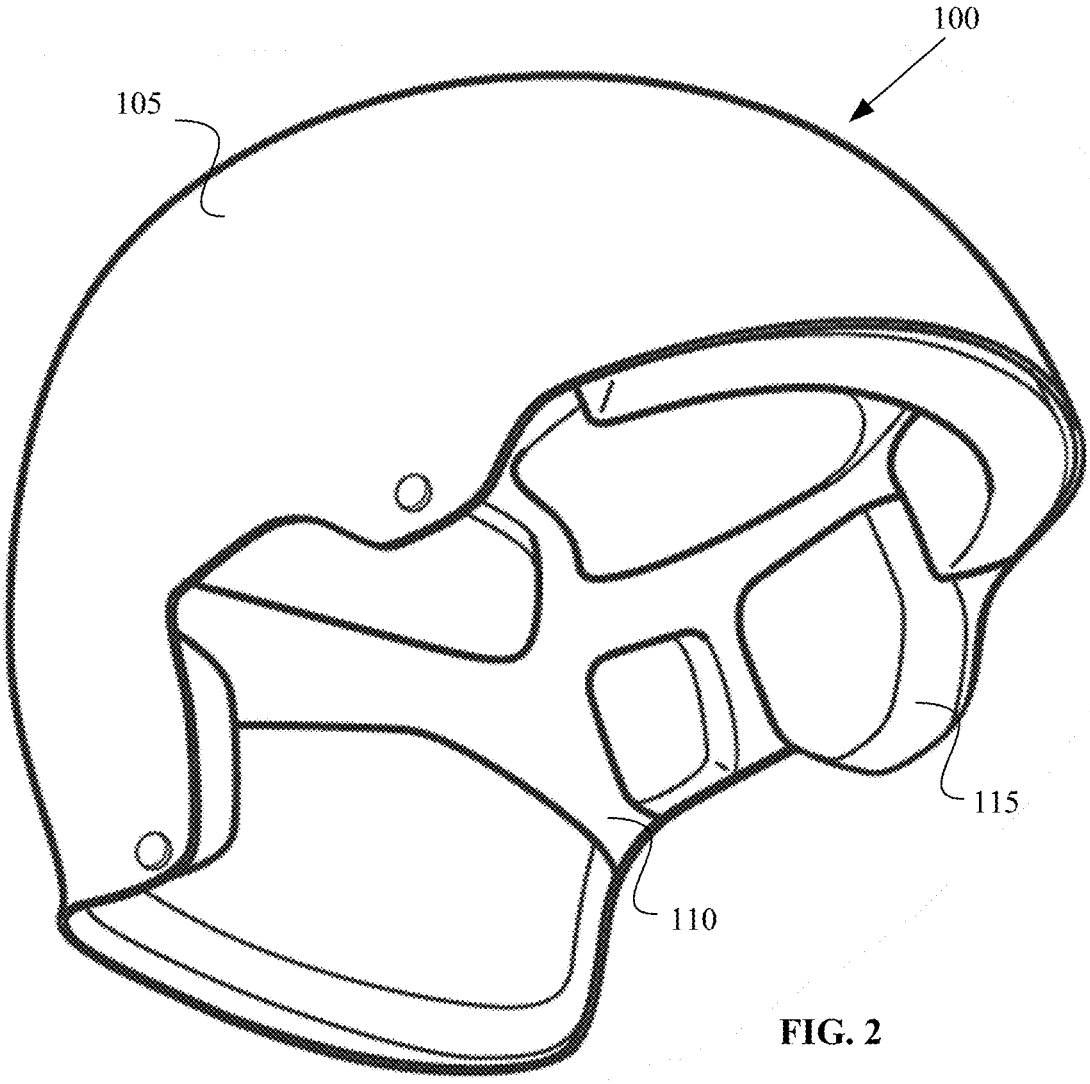
FIG. 2 is a perspective view a helmet and helmet system in accordance with at least one embodiment.
Figure 3:
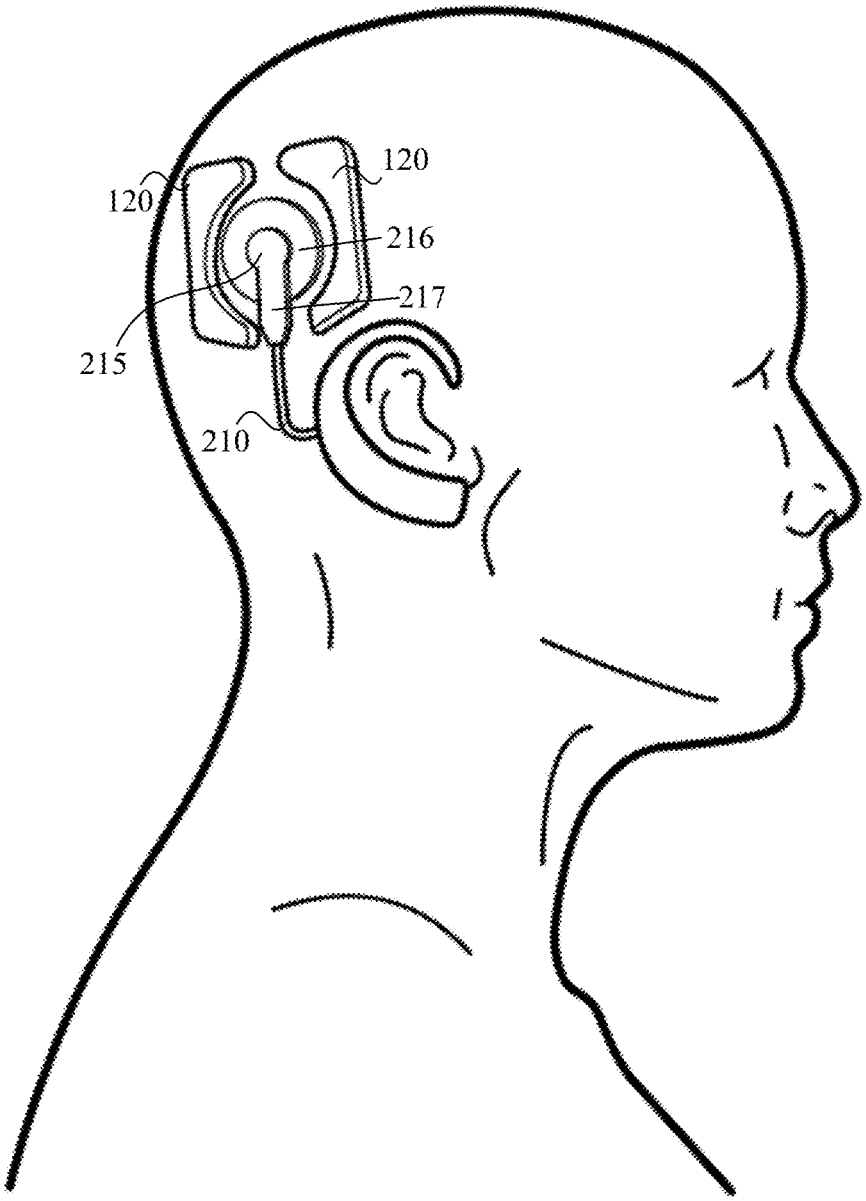
FIG. 3 is a side view of inserts of a helmet system with a helmet removed, for illustrative purposes to indicate an exemplary position of the inserts, in accordance with at least one embodiment, wherein the inserts encompass a transmitter component, and a cord of a cochlear implant.
Figure 4:
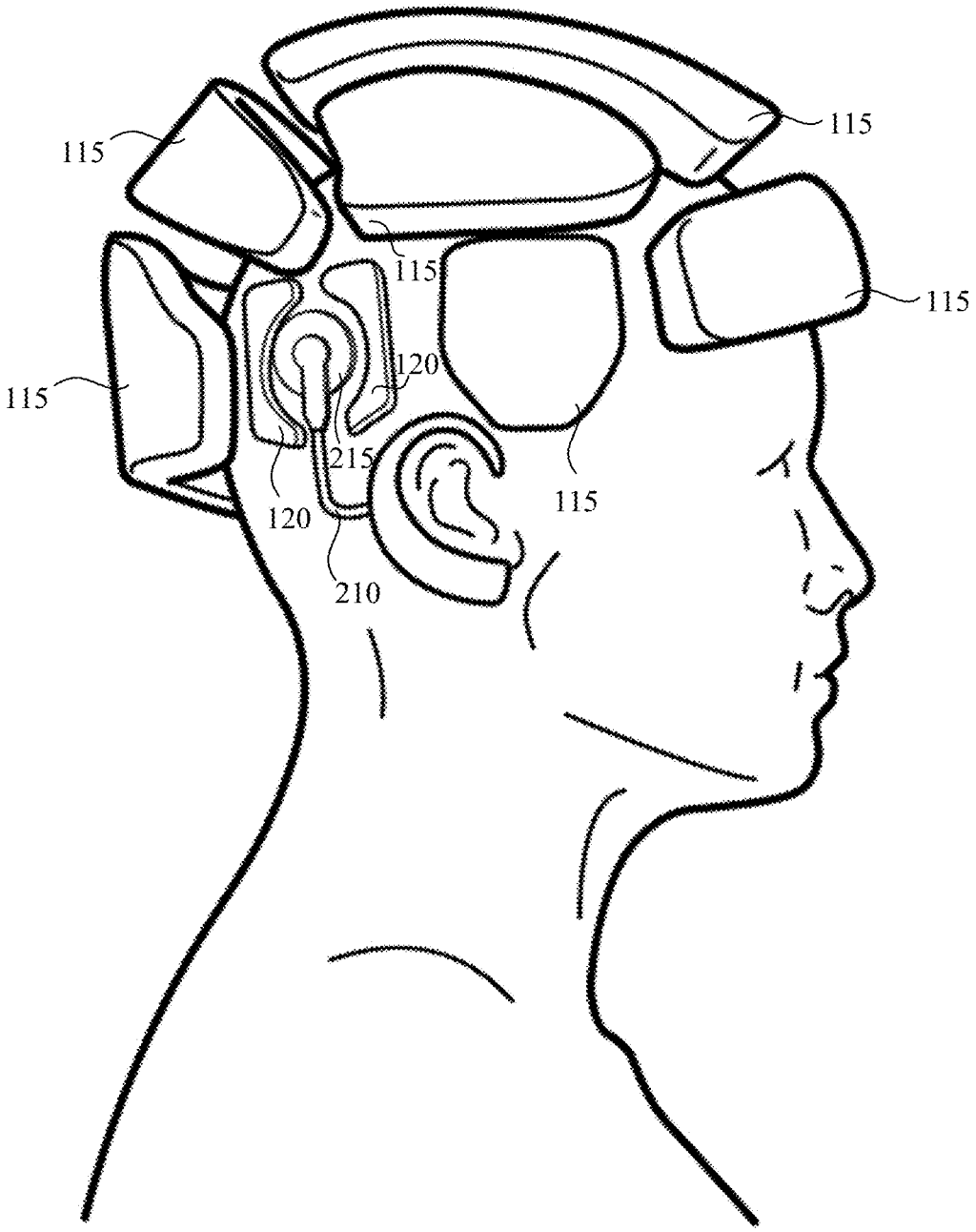
FIG. 4 is a side view of inserts and cushioning pads of a helmet system with the helmet removed and the cushioning pads partially exploded outwardly from a head, for illustrative purposes to show exemplary positioning of the cushioning pads relative to the head, in accordance with at least one embodiment, wherein the inserts encompass a transmitter component, and a cord of a cochlear implant.

More specifically, and as shown in FIGS. 1 and 2, a helmet 100 configured for a cochlear implant wearer may have an outer surface 105 and an inner surface 110. The helmet 100 may further include an upper portion. A front portion, a rear portion opposite the front portion, and a pair of side portions (left-side and right-side) depend from the upper portion. The rear portion, the pair of side portions, cooperate with the upper portion to form the inner surface having a substantially partial ellipsoidal shape. The helmet may further comprise at least one cushioning pad 115 positioned adjacent the inner surface and one or more inserts positioned against the inner. As shown in FIGS. 3 and 4, the insert(s) will form a void to encompass and protect the transmitter component 215 of the cochlear implant and a slot for the cord 210 of the cochlear implant. In the event that the wearer has two cochlear implants, there will be insert(s) on both the left-side and the right-side of the helmet to accommodate for two sets of inserts. The insert(s) 120 may be positioned on the inner surface of the helmet alongside cushioning pads 115. The insert(s) 120 will be selected to fit around the specific cochlear implant of the wearer and assembled within, or on, the inner surface 110 of the helmet based on the specific location of the cochlear implant on the wearers head. The insert(s) 120 may be assembled within an aperture formed by, or within, the cushioning pads 115 on the inner surface 110 of the helmet. The aperture may be rectangular, circular, an oval, or any other necessary shape to accommodate the cochlear implant and the insert(s).

Figure 5:
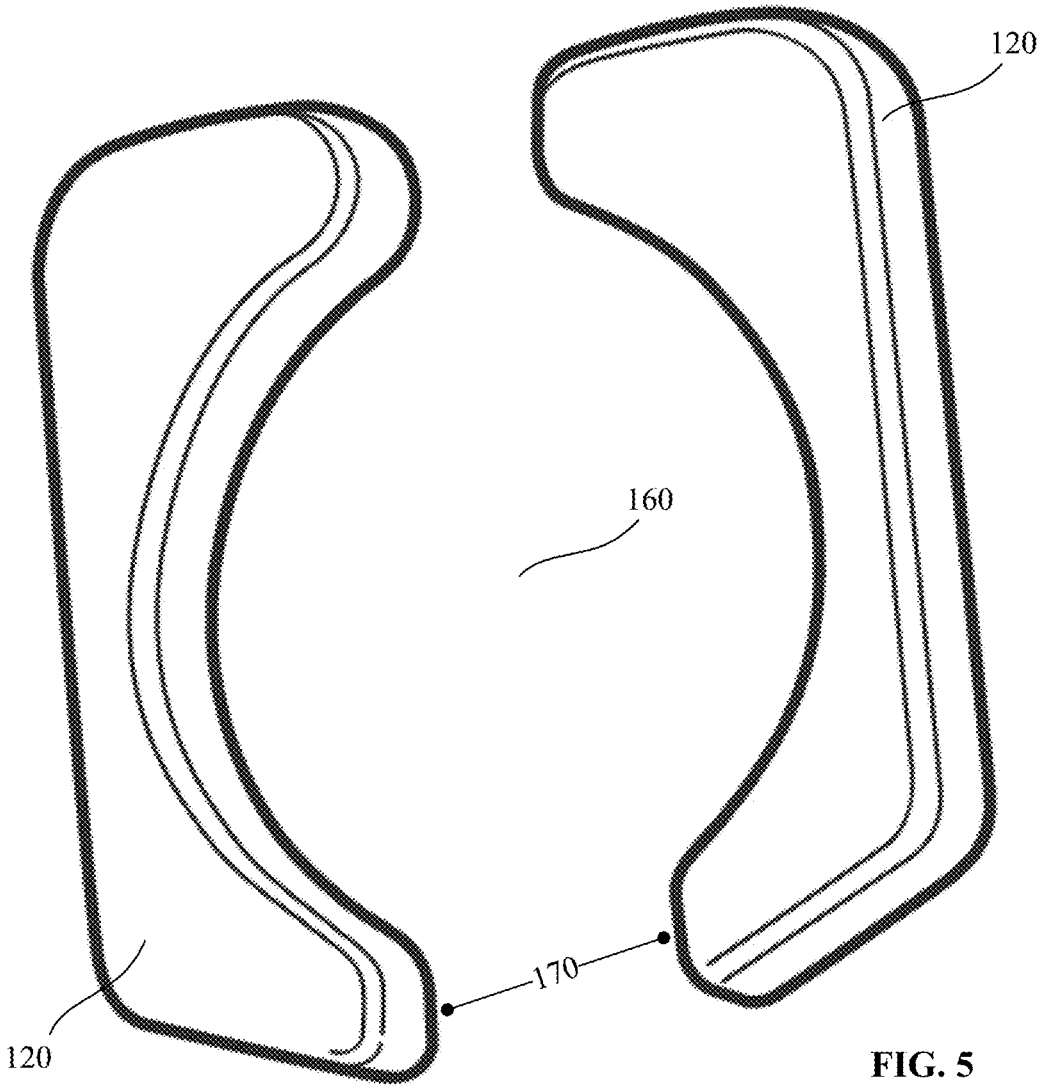
FIG. 5 shows two inserts in accordance with at least one embodiment.
Figure 6A:
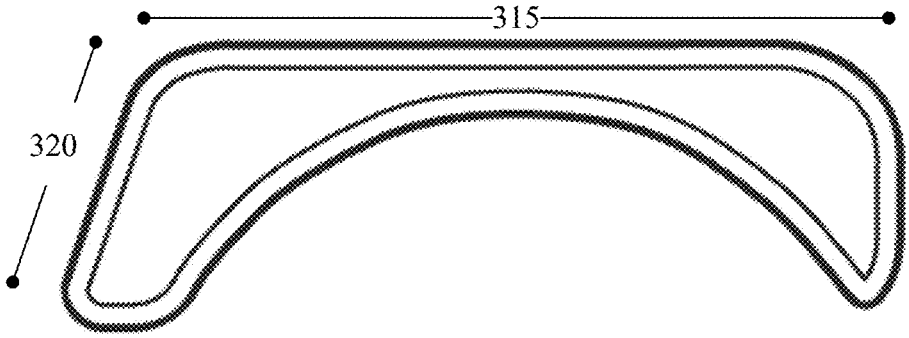
FIG. 6A shows a side view of one of the two inserts in accordance with at least one embodiment.
Figure 6B:
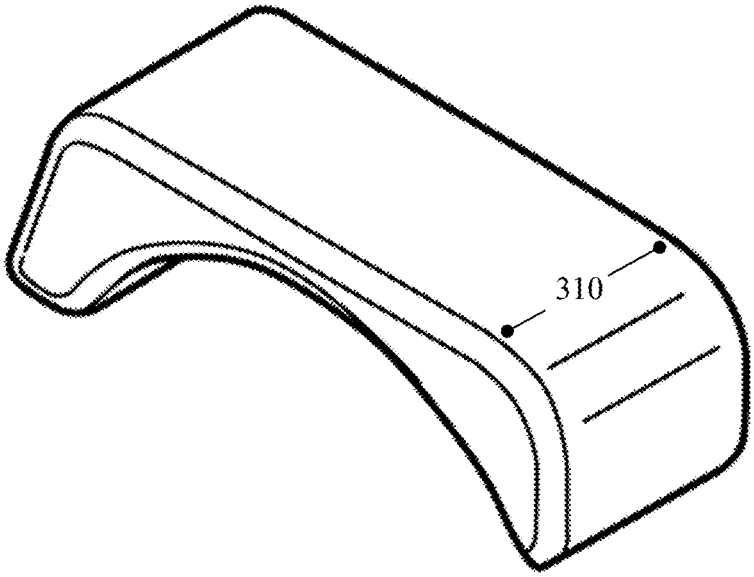
FIG. 6B shows a perspective view of one of the two inserts in accordance with at least one embodiment.

In some embodiments there may be one insert with a void for surrounding, or encompassing, the transmitter component of the cochlear implant. In some embodiments, FIGS. 3, 4, and 5, there may be two inserts that together form a void 160 for surrounding, or encompassing, the transmitter component of the cochlear implant, and a slot 170 for receiving the cord of the cochlear implant.

The inserts may be permanently applied to the inner surface of the helmet by a permanent adhesive or otherwise integrally formed into the helmet. Alternatively, the inserts may be adjustable and reversibly applied to the inner surface of the helmet by a re-stickable adhesive or hook-and-loop coupling.

The inserts may be formed of a shock-absorbing material. The shock-absorbing material may be expanded polystyrene foam, expanded polypropylene foam, polylactic acid (PLA) plastic, or any other crushable foam. The density of the foam may be tuned for the desired activity. For example, the foam may be of a higher density for harder impact activities, and a lower density for softer and more frequent impact activities.

A majority of cochlear implant transmitters have roughly the same size and dimension: a circular portion 216 that meets an elongated portion 217. The diameter of the circular portion 216 is on average 25 mm-33 mm while the elongated portion 217 has a length of 24 mm-30 mm and height of 18 mm-25 mm. To accommodate for these dimensions, a system having two inserts is disclosed, as shown in FIGS. 3, 4, 5, 6A, and 6B. The length 315 of one of the two inserts may be from about 55 mm to about 75 mm, more preferably from about 60 mm to about 70 mm, and most preferably from about 62 mm to about 66 mm. The width 320 of one of the two inserts may be from about 15 mm to about 30 mm, more preferably from about 18 mm to about 25 mm, and most preferably from about 21 mm to about 24 mm. The depth of the inserts may be from about 6 mm to 50.8 mm depending on the helmet function and desired cushioning. In the present embodiment, the depth 310 of one of the two inserts may be from about 15 mm to 35 mm, more preferably from about 20 mm to about 30 mm, and most preferably from about 24 mm to about 27 mm.

Figure 7:
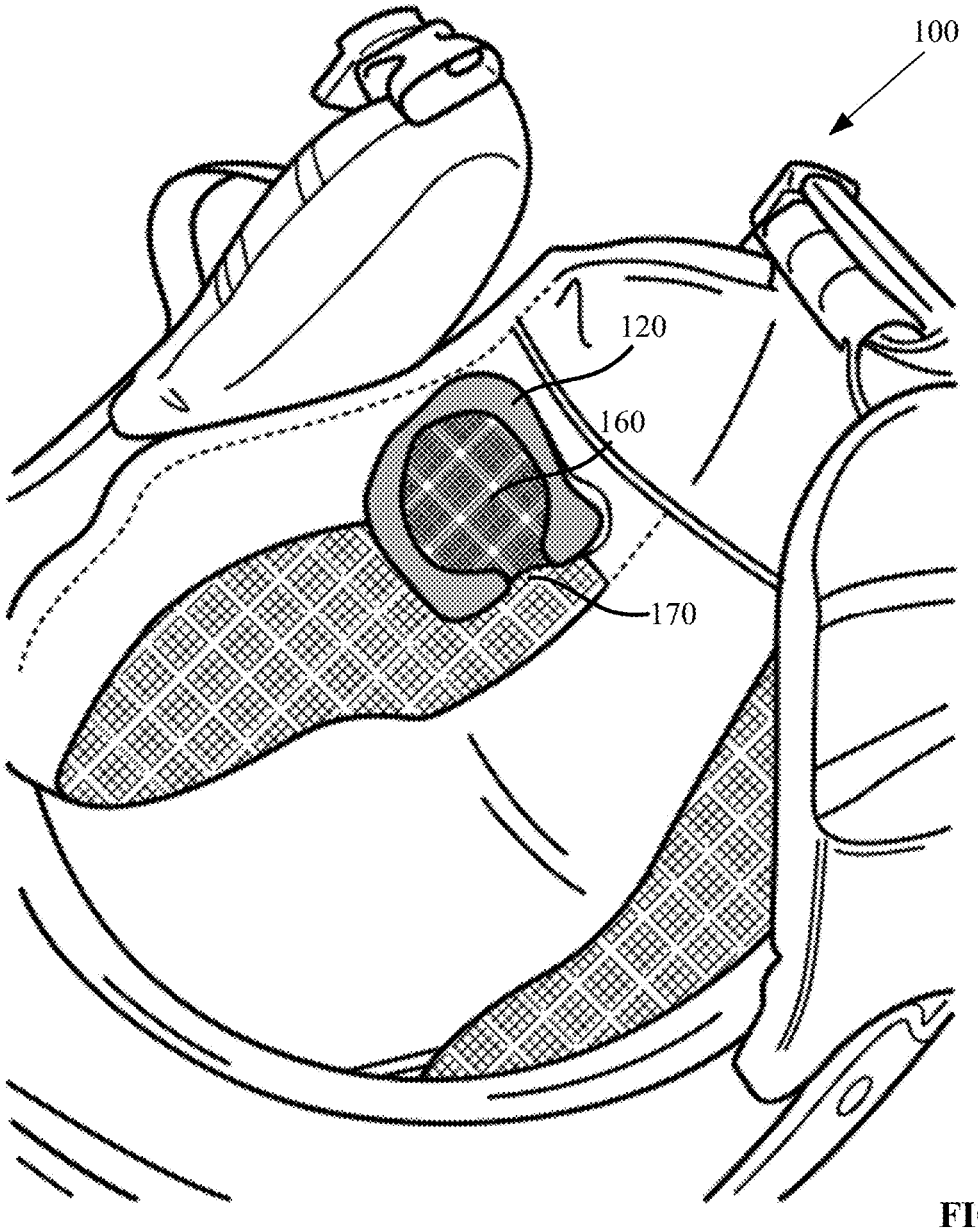
FIG. 7 is a bottom perspective view of a helmet in accordance with at least one embodiment of the present invention.

FIG. 7 illustrates a bottom perspective view of the helmet wherein the insert(s) 120, the cavity 160, and slot 170 can be seen.

The helmet, in its most simple form, will comprise the outer surface, the inner surface, and the insert(s) as described above. The helmet may further include a chin-strap connected to both the left-side and right-side of the helmet. The helmet may also further comprise ear warmers, made of felt, wool, or any other desired material coupled to the helmet to keep the wearer's ears warm when wearing the helmet in low temperatures. The helmet may also further comprise a visor coupled to the front of the helmet to protect the wearer's eyes from the sun. The helmet may also further comprise a protective facemask coupled to the front of the helmet.

A method of customizing the helmet to accommodate a wearer's head along with a cochlear implant device includes providing a piece of molding to the wearer to get an impression of the device and location of the device on the wearer's head. The molding may be any pliable material including but not limited to: starch-based modeling compounds; elastomeric impression materials such as alginate, agar, silicones, and polyethers; or any other mold putty, casting, or mold-making material. After receiving the mold and the impression contained therein from the wearer, the at least one insert may be selected and assembled to fit around the cochlear implant device and within the aperture of the helmet. The helmet may be further customized to the wearer's intent. This may include attaching a chin-strap to the front of the helmet. This may also include attaching a visor to the front of the helmet.

The use of computer software may streamline the process of customizing the helmet for each wearer. The impression on the molding may be analyzed via a computer software to determine the size, shape, and location of the at least one adjustable pad selected for use in the wearer's helmet. In some embodiments, a software may be used to analyze the wearer's head with the implant to determine the size, shape, and location of the at least one adjustable pad selected for use in the wearer's helmet.

The helmet may be configured for a specific activity, such as football, biking, hockey, baseball, cricket, lacrosse, horseback riding, skating, skiing, snowboarding, rugby, and any other activity that may require specific properties or accessories on its helmet. The outer surface of the helmet may be comprised of plastics such as polycarbonate. The outer surface of the helmet may also be comprised of carbon fiber, fiberglass, metal, or Kevlar depending on the intended activity. The outer surface may take many shapes depending on the activity the helmet is intended for.

In the instance that the helmet is being worn for a particular sport or activity, the helmet will have the appropriate dimensions, shape, and accessories. For example, if the helmet is configured for football, if the helmet is configured for football, the helmet will prescribe to the standard size and shape. The football helmet will be equipped with a face-mask and chin-strap. When the helmet is equipped with a face mask, the face mask may be metal such as carbon steel, stainless steel, or titanium to offer the wearer face protection in the event of a face-on collision.

In another example, the helmet may be configured for batting in baseball or softball. In this example, the helmet may be the appropriate size and shape for baseball or softball and comprise a visor. In some instances, a baseball or softball helmet may also comprise a face guard.

In yet another example, the helmet may be intended for use while the wearer is biking or cycling (bicycle or motorcycle). There are a wide variety of biking helmets, and the helmet described herein is intended to include all such variations. Biking helmets may have apertures on the hard outer shell along with corresponding apertures on the internal layers for airflow. Biking helmets may have visors configured on the front of the helmet to protect the wearer eyes from bright sunlight. Biking helmets frequently have a chin-strap configured on the front of the helmet to secure the helmet to the wearer's head. Biking helmets may also have a face guard which may be made of metal, plastic, fiberglass, etc. The face guard may be completely integrated with the outer shell of the helmet.

In yet another example, the helmet may be intended for use while the wearer is skiing or snowboarding. These helmets may often have ear guards and even ear warmers. Ski and snowboard helmets frequently also have a chin strap to secure the helmet to the wearers head.

Other examples of types of helmets encompassed by the present disclosure include: cricket helmets, skateboarding helmets, skating helmets, hockey helmets, lacrosse helmets, horseback-riding helmets, and any other sport or activity requiring a helmet.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A helmet comprising:

an outer surface;

an inner surface, the inner surface having a innermost upper portion, a front portion, a rear portion opposite the front portion, a pair of side portions opposite each other and extending between the front portion and the rear portion, wherein each of the front portion, the rear portion and the pair of side portions depend from the innermost upper portion and cooperate with the innermost upper portion to form the inner surface having a substantially partial ellipsoidal shape;

at least one cushioning pad positioned on the inner surface defining an aperture, wherein the aperture is defined at one of the pair of side portions configured to correspond to the general position of an external portion of a cochlear implant device of a wearer of the helmet; and a pair of inserts positioned on the inner surface within the aperture, the pair of inserts forming a void therebetween configured to encompass and support an external portion of the cochlear implant device, wherein each of the pair of inserts are mirror images of each other and are spaced from each other to form a slot continuous with the void, and wherein the pair of inserts each have a length, a width, and a depth, the length is in a range of 55 to 75 millimeters, the width is in a range of 15 to 30 millimeters, and the depth is in a range of 15 to 35 millimeters.

2. The helmet according to claim 1, wherein the inserts are polystyrene, polylactic acid, polyurethane, silicone, expanded polystyrene, neoprene, and some combination thereof.

3. The helmet of claim 1, wherein the pair of inserts are attached to the inner surface of the helmet by hook-and-loop coupling or an adhesive.

* * * * *